US007094126B1

(12) United States Patent
Lenihan

(10) Patent No.: US 7,094,126 B1
(45) Date of Patent: Aug. 22, 2006

(54) TOY KITCHEN SET WITH REPOSITIONABLE ISLAND

(75) Inventor: Gary G. Lenihan, Hudson, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 09/704,028

(22) Filed: Nov. 1, 2000

(51) Int. Cl.
*A63H 3/52* (2006.01)
*A63H 33/30* (2006.01)

(52) U.S. Cl. ..... 446/481; D21/523

(58) Field of Classification Search ..... 446/479, 446/481, 480, 476, 482, 477, 397, 478, 39; 434/382, 383, 365, 72, 73, 80, 79; 134/433; D21/523, 524
See application file for complete search history.

(56) References Cited

U.S. PATENT DOCUMENTS

| | | | | |
|---|---|---|---|---|
| 1,587,305 | A * | 6/1926 | Hartman | 446/481 |
| 1,795,791 | A * | 3/1931 | Neuhaus | 446/332 |
| 3,133,376 | A | 5/1964 | Orenstein | 46/14 |
| 3,289,664 | A | 12/1966 | Hewitt | 126/37 |
| 3,904,041 | A * | 9/1975 | Medgebow | 211/72 |
| 4,135,315 | A * | 1/1979 | McKee | 434/79 |
| 4,161,081 | A * | 7/1979 | Katzman et al. | 446/314 |
| 4,333,258 | A | 6/1982 | McCaslin | 46/14 |
| 4,515,359 | A * | 5/1985 | Mariol | 446/141 |
| D294,277 | S | 2/1988 | Kamentsky | D21/122 |
| D299,839 | S | 2/1989 | Argandona | D21/122 |
| D328,623 | S | 8/1992 | Zinter-Chahin | D21/122 |
| 5,163,536 | A | 11/1992 | Tuhro et al. | 186/44 |
| D345,592 | S | 3/1994 | Houry et al. | |
| D370,947 | S | 6/1996 | Pipik | |
| 5,944,143 | A | 8/1999 | Papas et al. | 186/44 |
| 6,048,251 | A * | 4/2000 | Klitsner et al. | 446/479 |

FOREIGN PATENT DOCUMENTS

| | | | |
|---|---|---|---|
| DE | 19700149 | A1 * | 7/1988 |
| DE | 19700149 | A1 * | 7/1998 |
| DE | 19700194 | A1 * | 7/1998 |

* cited by examiner

*Primary Examiner*—Bena Miller
(74) *Attorney, Agent, or Firm*—Renner, Otto, Boisselle & Sklar, LLP

(57) ABSTRACT

A toy kitchen including a main unit and at least one island. Each island is removably coupled to the main unit in one of at least two positions. The island includes a frame and a coupling mechanism attached to the frame. The coupling mechanism is configured to removably couple the island to the toy kitchen in at least one position. A repositionable toy kitchen includes a first unit extending along a first longitudinal plane and a second unit extending along a second longitudinal plane. The second unit is positionable adjacent to the first unit in a first position, in which the first longitudinal plane is angled with respect to the second substantially vertical longitudinal plane, and a second position, in which the first and second longitudinal planes are substantially coplanar. A toy kitchen also may include a main unit and at least two countertop sections coupled to the main unit.

5 Claims, 5 Drawing Sheets

TOY KITCHEN SET WITH REPOSITIONABLE ISLAND

FIELD OF THE INVENTION

The present invention relates generally to the field of toy kitchens. More particularly, the invention relates to a toy kitchen having a repositionable island.

BACKGROUND OF THE INVENTION

Children enjoy engaging in activities that are realistic, attractive, amusing and instructive. Children particularly enjoy imitating various activities encountered in everyday household life, including entertaining, cooking, and performing routine household chores, such as washing dishes. Toy kitchen sets enable children to participate in role playing, including entertaining, cooking, cleaning and assisting others.

Existing toy kitchen sets typically include a single upstanding structure having a general rectangular shape and a front play area. The toy kitchens typically include a number of conventional toy kitchen accessories accessible to a child from the front play area. The toy kitchen accessories can typically include a sink, a stove, a set of cabinets, a set of shelves, a microwave, a dishwasher, a refrigerator or other conventional accessories. Existing toy kitchen sets can also include a single counter top extension typically pivotally connected to the kitchen set.

Existing toy kitchens, however, have a number of drawbacks. Modern, full size kitchens often include an island which may be positioned apart from the other structures of the kitchen or may be positioned to outwardly extend from one of the structures of the kitchen. The islands can be equipped with any of the typical conventional kitchen accessories such as, for example, a sink, a stove, a set of cabinets and a set of shelves. Existing toy kitchens typically do not include an island. Existing toy kitchens also typically include only a single front play area, which is typically sized to generally only comfortably accommodate only one child. Additionally, existing toy kitchen sets are typically not reconfigurable to enhance the children's play and to maintain the children's attention for an extended period of time.

Thus, there is a continuing need for a toy kitchen set which includes an island having at least one toy kitchen accessory. What is needed is a toy kitchen which can be easily reconfigured into a number of different positions to attract and maintain the attention of children. There is also a continuing need for a toy kitchen set which defines distinct play areas for enabling more than one child to actively play with the toy kitchen. What is also needed is a toy kitchen that can be readily displayed within the existing shelving limitations of toy retailers.

SUMMARY OF THE INVENTION

The present invention provides a toy kitchen which is easily reconfigurable into multiple positions. The toy kitchen is configured to define numerous distinct play areas to accommodate the play of more than one child. The toy kitchen is also configured for display within the existing shelf space limitations of toy retailers.

The present invention provides a toy kitchen including a main unit and an island. The island is removably coupled to the main unit in one of at least two positions.

The present invention also provides an island for a toy kitchen. The island includes a frame and a coupling mechanism attached to the frame. The coupling mechanism is configured to removably couple the island to the toy kitchen in at least one position.

The present invention provides a repositionable toy kitchen including a first unit and at least one second unit. The first unit extends along a first substantially vertical longitudinal plane. Each second unit extends along a second substantially vertical longitudinal plane. Each second unit is positionable adjacent to the first unit in a first position, in which the first longitudinal plane is angled with respect to the second longitudinal plane, and a second position, in which the first and second longitudinal planes are substantially coplanar.

The present invention provides a toy kitchen including a main unit and at least two countertop sections. The at least two countertop sections are pivotally coupled to the main unit.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
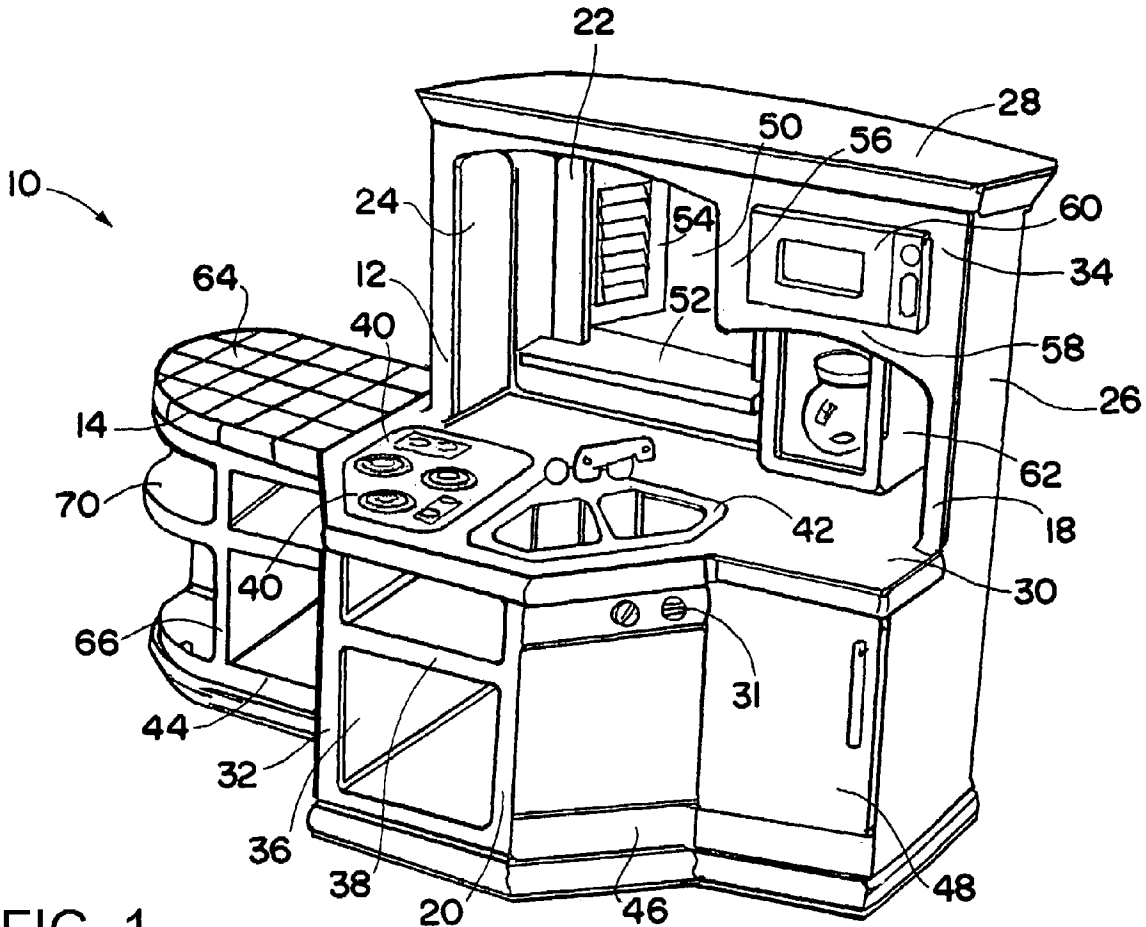
FIG. 1 is a front perspective view of a first configuration of a toy kitchen in accordance the present invention.

FIG. 1 is a front perspective view of a toy kitchen 10 including a main unit 12 and a repositionable island 14. The main unit 12 is an upstanding, generally polygonal, primary kitchen structure configured for placement onto a generally horizontal surface 16 (see FIG. 4). The main unit 12 removably connects to the island 14 in one of at least three separate positions. The main unit 12 is also configured to integrate a large number of toy kitchen accessories into a single structure. The main unit 12 enables the accessories to be optimally positioned to replicate the look and feel of an actual kitchen, and to attract and retain a child's attention during play.

Figure 4:
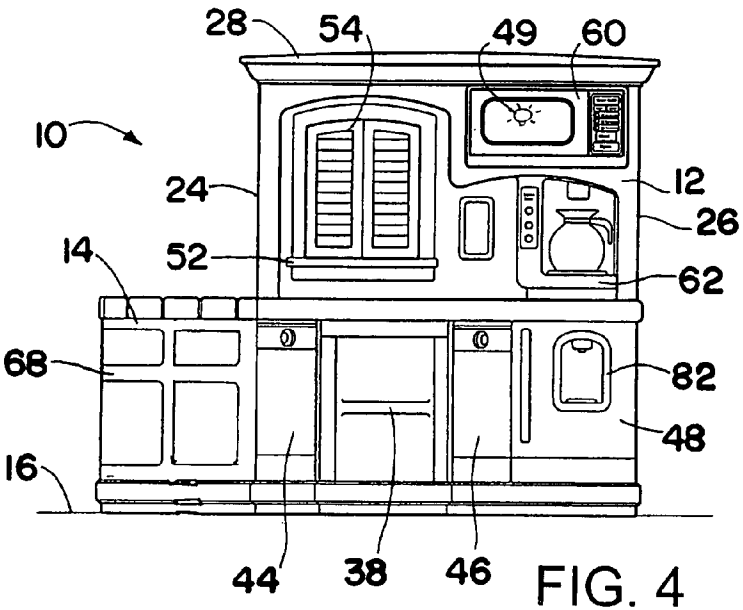
FIG. 4 is a front view of the toy kitchen of FIG. 1.

The main unit 12 includes a frame 18 having a front wall 20, a rear wall 22, opposing first and second side walls 24, 26, a top surface 28 and a counter top 30. The front, rear, left and right walls, 20, 22, 24, 26 are interconnected and upwardly extend from the generally horizontal surface 16 (FIG. 4). The countertop 30 forwardly extends in a generally horizontal position from the a mid-portion of the rear wall 22. The countertop 30 connects with the first and second side walls 24, 26 and the top of the front wall 20 to define a lower frame portion 32. The front wall 20 includes a plurality of openings for providing access to storage space defined within the lower frame portion 32. The depth of the main unit 14 at the left and right side walls 24, 26 is preferably 18 inches or less.

In a preferred embodiment, the lower frame portion 32 forwardly projects beyond the upper frame portion 34 to increase the storage capacity of the lower frame portion 32 and the size of the countertop 30. In a preferred embodiment, the lower frame portion 32 includes at least one generally vertically positioned dividing walls 36 and at least one generally horizontally positioned shelf 38 extending between dividing walls 36 or between a dividing wall 36 and a first or second side wall 24, 26. The lower frame portion 32 also includes the following toy accessories: a stove top 40, a sink 42, an oven 44, a dishwasher 46 and a refrigerator 48. The stove top 40 and the sink 42 are inserted through openings defined within the countertop 30. Alternatively, the stove top 40 and the sink 42 can be integrally formed to the counter top 30. The oven 44, the dishwasher 46 and the refrigerator 48 each include a front door pivotally connected to the front wall 20 of the lower frame portion 32. In an alternative preferred embodiments, other combinations and configurations of toy kitchen accessories in the toy kitchen 10 can be used. Moreover, the toy kitchen 10 can also include sound generating devices (such as a speaker 31), light generating devices (such as a light 49 (see FIG. 4)), and other electronic controls.

The rear wall 22, and the first and second side walls 24, 26 upwardly extend beyond the countertop 30 and connect with the top surface 28 to define an upper frame portion 34. The rear wall 26 of the upper frame portion 34 includes a window opening 50 and a window sill 52 and a pair of shutters 54 connected to the rear wall 22 at the opening 50. The upper frame portion 34 further includes a generally vertically positioned extension 56 downwardly extending from the top surface 28 and connected to a generally horizontal extension 58 to form an appliance receiving area. In a preferred embodiment, a toy microwave 60 is positioned at the receiving area defined by the extensions 56, 58 and a toy coffee maker 62 is connected to the underside of the horizontal extension 58.

The island 14 is an upstanding storage structure configured for placement on the generally horizontal surface 16 (see FIG. 4). The island 14 can be removably connected to the main unit 12 through the use of any conventional fastening means, such as, for example, hook and loop fasteners, snap-fit fasteners, straps, quick release buckles, hooks, and tongue and groove fasteners. The island 14 includes an island countertop 64 and a plurality of generally horizontal and vertical support members 66 defining storage compartments or toy appliance locations within the island 14. In one preferred embodiment, the island 14 includes at least one shelf 70. The island 14 is configured to serve as a stand alone kitchen sub-assembly or to removably connect to the main unit 14 in one of at least three different positions. Furthermore, if two islands are provided, one can be coupled to the main unit 12 at any of the described locations and the second can be free standing. Alternatively, the two can be coupled to the main unit 12 at any two of the three attachment locations. Alternatively, the two islands can be coupled to each other in a position apart from the main unit 12.

The frame 18 of the main unit 12 and the island 14 are each preferably formed as a single molded article, but alternatively, the frame 18 or the island 14 can be made of two or more assembled components. The main unit 12 and the island 14 are made of a durable, lightweight and inexpensive material. The main unit 12 and island 14 are preferably made of rotationally molded plastic and, alternatively, can be made of other materials, such as, for example, other plastics, sheet metal, wood or ceramics. The main unit 12 and island 14 can also be produced in a variety of colors or color combinations. In alternative preferred embodiments, the main unit 12 and the island 14 can be configured to include any combination of the following toy kitchen accessories: an oven, a stove, a sink, a dishwasher, a refrigerator, a microwave oven, a coffee maker, an ice dispenser, a cutting board, a clock, a set of shelves and a set of cabinets.

When a single island 14 is used, it is preferably positionable in at least four positions. In a first position, the island 14 is separated from the main unit 12 to form a stand alone kitchen sub-assembly. In this position, the toy kitchen 10 substantially replicates full size kitchens which include a detached island. In the first position, children can approach the main unit 12 or the island 14 during play from any point about the perimeter of the main unit 12 and the island 14.

Figure 3:
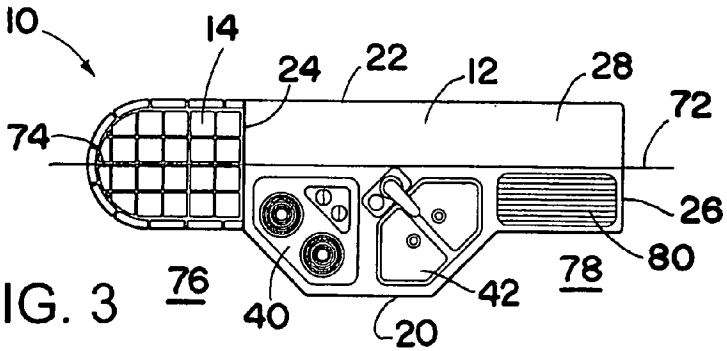
FIG. 3 is a top view of the toy kitchen of FIG. 1.

In a second position, as shown in FIGS. 1, 3 and 4, the island 14 is removably connected to the first side wall 24 of the main unit 12. As best shown in FIG. 3, in the second position, a plane 72 longitudinally extending through the main unit 12 is substantially coplanar with a plane 74 longitudinally extending through the island 14. The substantially coplanar configuration of the main unit 12 and the island 14 enables the kitchen 10 to be easily positioned against a wall or on a display shelf and provides an extended front play area for children. Alternatively, the toy kitchen 10 can be positioned away from a wall, enabling children to play about the perimeter of the kitchen 10. A portion of the front wall 20 of the main unit 12 forwardly projects with respect to the kitchen 10, thereby defining two distinct play areas 76, 78. The first play area 76 is defined by the forward edge of the island 14 and the portion of the front wall 20 adjacent to the stove top 40. The second play area 78 is defined by the portion of the front wall 20 adjacent to the sink 42 and the portion of the front wall 20 adjacent to the second side wall 26. FIG. 3 also illustrates a toy cutting board 80 formed into the countertop 30 of the main unit 12. FIG. 4 illustrates a toy ice dispenser 82 formed within the refrigerator 48.

Figure 2:
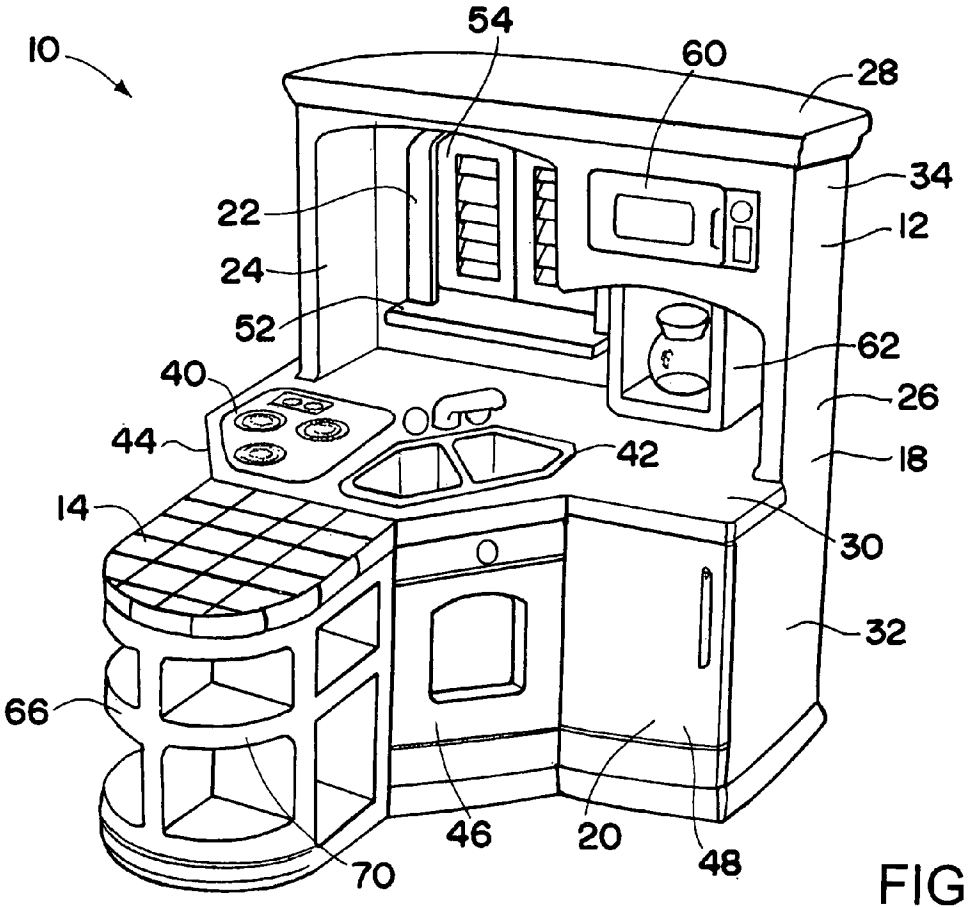
FIG. 2 is front perspective view of a second configuration of the toy kitchen of FIG. 1.
Figure 5:
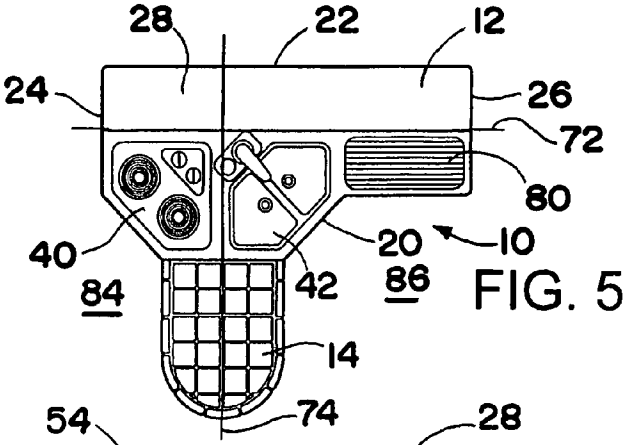
FIG. 5 is a top view of the toy kitchen of FIG. 2.
Figure 6:
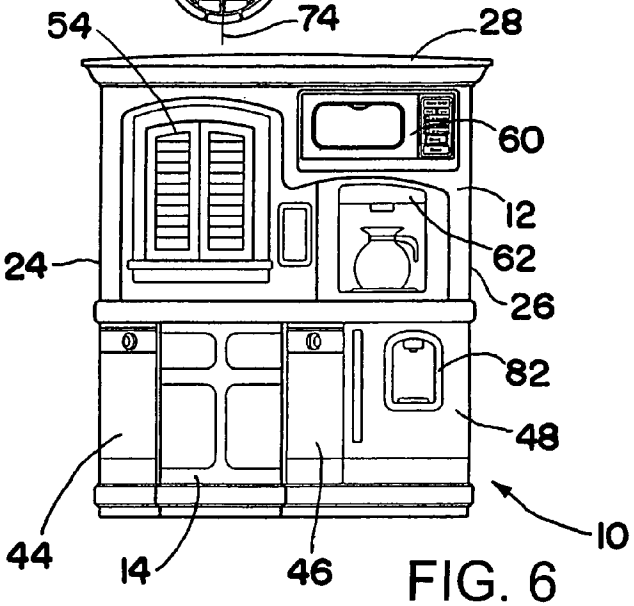
FIG. 6 is a front view of the toy kitchen of FIG. 2.

In a third position, as illustrated in FIGS. 2, 5 and 6, the island 14 is removably connected to the front wall 20 of the main unit 12. As best shown in FIG. 5, in the third position, the longitudinal plane 74 of the island 14 is positioned substantially perpendicular to the longitudinal plane 72 of the main unit 12 giving the kitchen 10 an approximate 'L' shape. In the third position, the island 14 and the front wall 20 of the main unit 12 define two additional distinct play areas 84, 86. The play area 84 is bounded by one side of the island 14 and the portion of the front wall 20 adjacent to the stove top 40. The other play area 86 is bounded by an opposite side of the island 14, the front wall portion adjacent to the sink 42 and the front wall portion adjacent to the cutting board 80. The play areas 84, 86 enable two children to easily play with the kitchen 10 without interfering with one another. The third position can also readily accommodates play by three or more children about the perimeter of the toy kitchen 10.

Figure 7:
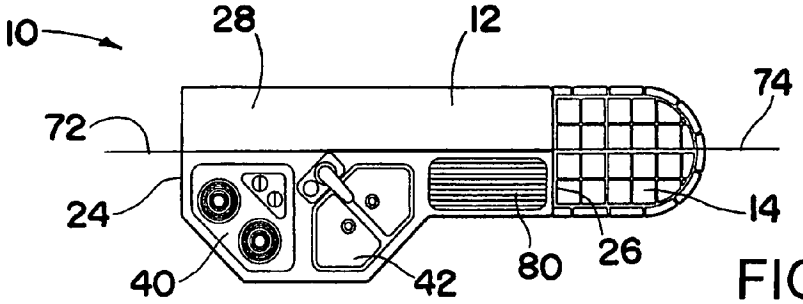
FIG. 7 is a top view of a third configuration of the toy kitchen of FIG. 1.
Figure 8:
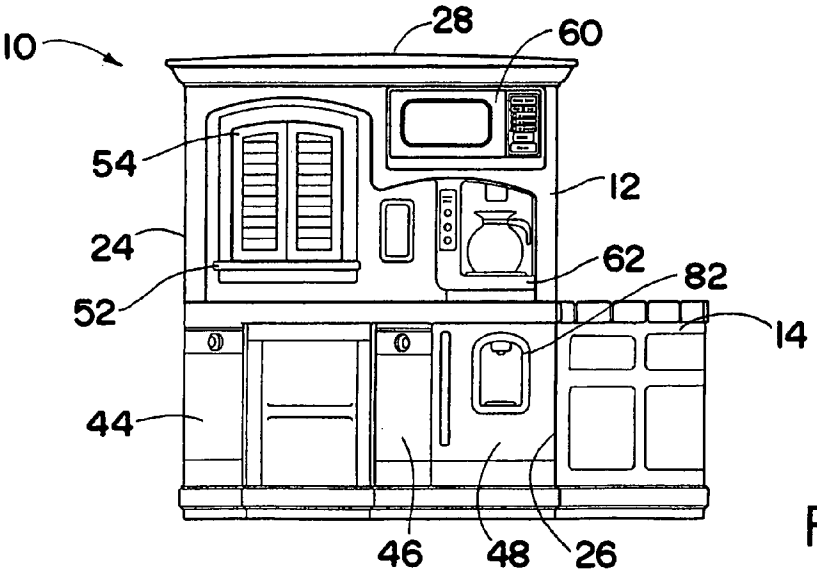
FIG. 8 is a front view of the toy kitchen of FIG. 7.

FIGS. 7 and 8 illustrate the kitchen 10 in a fourth position. In the fourth position, the island 14 is removably connected to the second side wall 26 of the main unit 12 such that the longitudinal plane 72 extending through the main unit 12 and the longitudinal plane 74 extending through the island

14 are substantially coplanar. In the fourth position, the main unit 12 and the island 14 combine to provide a long front play area for children.

The removable connection and repositioning of the island 14 maximizes the versatility of the toy kitchen 10 making the kitchen 10 more attractive and enjoyable to children. The repositionable island 14 allows a child or another user to control and adjust the configuration of the kitchen 10 to enhance the child's play experience and retain a child's attention.

The toy kitchen 10 further overcomes the difficulties inherent with the display of many large toy items in toy retail stores. Existing shelf space limitations in many retail stores prevent large toy items from being displayed on such retailers' shelves. Many retailers have shelf depth limitations, which can be as low as approximately 18 inches. Such limitations have prevented the display of large three dimensional objects, including an 'L' shaped toy kitchen. The toy kitchen 10 with the repositionable island 14 overcomes these difficulties by enabling the kitchen 10 to be positioned in the second or fourth positions and, therefore, easily fit within the retail shelf space limitations of retailers, including shelf space limitations as low as approximately 18 inches. Such a display would preferably be accompanied by a photograph or figure of the toy kitchen in the first or third positions. The two piece configuration of the toy kitchen 10 also facilitates the transportation and storage of the toy kitchen 10 by enabling the toy kitchen 10 to be separated into two smaller and lighter individual sub-assemblies.

Figure 9:
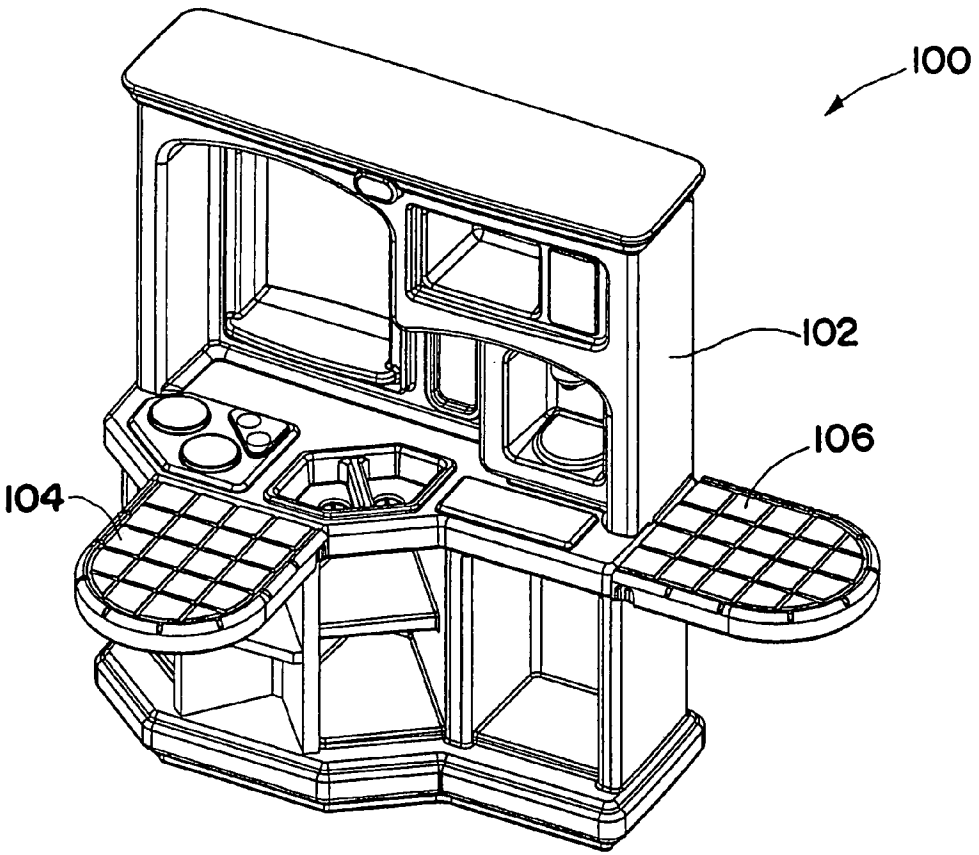
FIG. 9 is a front perspective view of a toy kitchen in accordance with an alternative preferred embodiment of the present invention.

FIG. 9 illustrates an alternative preferred embodiment of a toy kitchen 100. The toy kitchen 100 includes a main unit 102, which is equivalent to the main unit 12, and at least a first and a second pivotable countertop extensions 104, 106. Each countertop extension 104, 106 is a generally flat sheet configured to resemble to a countertop. The first countertop extension 104 is pivotally coupled to a front wall of the kitchen 100 and the second countertop extension is pivotally coupled to a side wall of the kitchen 100. Other locations for the connection of the first and second counter top extensions 104, 106 to the main unit 102 are contemplated. Each countertop extension 104, 106 is positionable in a first position in which the countertop extension 104, 106 is substantially vertically aligned adjacent to a wall of the kitchen 100 and a second position, in which the countertop extension 104, 106 is releasably locked into a substantially horizontal position.

The countertop extensions 104, 106 are preferably pivotally connected to the main unit using hinges. However, alternative pivotable connection mechanisms are contemplated and can be employed, such as, for example, a hook and latch mechanism, a spring lock and tongue and groove connectors. The extensions 104, 106 increase the versatility of the toy kitchen 100 by enabling a user, such as a child, to easily reconfigure the toy kitchen 100 between at least four different play positions. The extensions 104, 106 further enhance the play experience of one or more children by defining different play locations for accommodating two or more children. The extensions 104, 106, when positioned in a substantially horizontal position, are configured to simulate a dining surface or an extended countertop surface, and to support other toys, such as, for example, toy dishes and toy pots. The countertop extensions 104, 106 are made of a durable, lightweight and inexpensive material. The countertop extensions 104, 106 are preferably made of rotationally molded plastic and, alternatively, can be made of other materials, such as, for example, other plastics, sheet metal, wood or ceramics. The countertop extensions 104, 106 can also be produced in a variety of colors or color combinations.

While preferred embodiments of the present invention have been described and illustrated, numerous departures therefrom can be contemplated by persons skilled in the art, for example, the main unit and the island can be configured to fold up or collapse for easy storage and transportation. Additionally, the toy kitchen can be equipped with one or more fully functional appliances. Therefore, the present invention is not limited to the foregoing description but only by the scope and spirit of the appended claims.

What is claimed is:

1. A toy kitchen comprising:

a main unit having a front surface at a front side thereof; and a repositionable island removably attachable to the main unit at the front side thereof with the repositionable island being perpendicular to the front surface of the main unit thereby forming at least two separate play areas;

wherein the main unit includes a rear side opposite the front side of the main unit, and wherein an opening is defined within the main unit extending from the front side to the rear side, and wherein the main unit further comprises at least one of a window sill and a pair of shutters positioned at the opening.

2. The toy kitchen of claim 1, wherein the repositionable island is removably attached to the front surface of the main unit.

3. A toy kitchen comprising:

a main unit ornamented to look like a kitchen, the main unit having a front wall, opposite side walls, and a countertop extending lengthwise between the side walls; and a repositionable island ornamented to look like a kitchen island, the repositionable island being removably attachable to the front wall of the main unit with the repositionable island extending away from the front wall of the main unit thereby to form at least two separate play areas at respective sides of the repositionable island, and the repositionable island being attachable to the front wall of the main unit at a location spaced inwardly from the side walls whereby each of the play areas is bounded by the front wall of the main unit and a respective end portion of the main unit.

4. The toy kitchen of claim 3, wherein the repositionable island has a countertop, and the countertop extends perpendicular to the countertop of the main unit when the repositionable island is attached to the front wall of the main unit and forms a continuation of the countertop of the main unit when the repositionable island is attached to a side wall of the main unit.

5. The toy kitchen of claim 4, wherein the repositionable island is removably attached to the main unit at one of the front and side walls.

* * * * *